United States Patent [19]

Lynch

[11] Patent Number: 4,682,419

[45] Date of Patent: Jul. 28, 1987

[54] NECKTIE-TYING GAUGE

[76] Inventor: Leo E. Lynch, 1738 Virginia St., Racine, Wis. 53406

[21] Appl. No.: 797,201

[22] Filed: Nov. 12, 1985

[51] Int. Cl.[4] ..... G01B 3/00

[52] U.S. Cl. ..... 33/613

[58] Field of Search ..... 33/180 R, 137, 176, 33/177; 2/146; 224/202

[56] References Cited

U.S. PATENT DOCUMENTS 2,254,993 9/1941 Brown ..... 2/146

2,806,286 9/1957 Weiner ..... 33/138 X 3,292,261 12/1966 Hayes ..... 33/137 R 3,321,773 5/1967 Orciuch ..... 2/146

*Primary Examiner*—Harry N. Haroian

[57] ABSTRACT

An improved gauge to aid in tying neckties into proper alignment. The gauge is a long narrow flexible piece of predetermined length and having a proximal end and a distal end, and fastening devices, preferably two pairs near the proximal end and at a predetermined intermediate position which when properly joined determine positions allowing tying of neckties into proper alignment for various kinds of knots and/or neck sizes.

2 Claims, 2 Drawing Figures

NECKTIE-TYING GAUGE

FIELD OF THE INVENTION

This invention is related generally to gauges to aid in tying neckties into proper alignment and, more particularly, to gauges of the type which can be used by someone as an aid in tying any of his neckties.

BACKGROUND OF THE INVENTION

Four-in-hand neckties are by far the most popular type of male neckwear today. Four-in-hand neckties are, of course, the type of necktie tied into a slipknot under the wearer's chin with wide and narrow portions hanging along his shirtbutton line.

Ever since four-in-hand neckties became popular in the 1870's, tying such ties into proper alignment of the ends has been a troublesome problem for millions of men and boys who wear them. Such neckties are in proper alignment, of course, when the ends of the wide and narrow portions are at the same level somewhere near the wearer's belt line, although for some proper alignment is when the end of the wide portion is a bit lower than the end of the narrow portion so that the narrow portion is well hidden behind the wide portion.

Millions of men and boys often have to tie, untie and tie a necktie repeatedly until the ends are in proper alignment. Even many who have worn ties for years find that multiple tying is a frequent requirement.

For some, the problem is avoided by buying pre-tied neckties which have metal or plastic clips for attachment near the collar of a shirt. This is the solution typically used for young boys. Since "clip-ons" have appearance drawbacks, their use is limited mainly to young boys. For many young boys, moving on to four-in-hand neckties which require tying is a part of growing up, and they struggle to achieve the level of incompetence of their fathers.

Many inventions have been made over the years addressing the need of making tie tying a less troublesome exercise for males. A number of patents have been granted on such inventions, including U.S. Pat. Nos. 2,499,260; 2,739,313; 3,305,933; 3,747,220; 1,917,651; 2,148,154; 3,321,773; 2,994,886; 2,343,979; 2,504,843; 3,797,044; 3,025,528; 3,490,073; 3,271,780; 3,335,426; and 3,571,935.

In spite of such efforts, the problem remains. There are a number of drawbacks and disadvantages in the tie-tying aids of the prior art. Many of the prior tie-tying aids involved marks of various kinds on the tie itself, including dots, notches, stripes and loops. Aids of this type have the disadvantage that they are useful only for help in tying the tie to which they are attached. They provide no aid whatever for any other necktie.

Other devices of the prior art include various scales and wall-mounted devices against which a tie is placed before it is put around the wearer's neck for tying. Such devices are intended to give some guidance in the tying operation, but they have significant drawbacks. For one thing, there can be many a slip between the gauge and the neck. When the tying operation is occurring there is nothing to use for guidance. Furthermore, such devices may have limited portability such that they cannot conveniently be carried while traveling.

Some prior art devices are rather complex and/or difficult to understand. Others do not account for the differences in neck size of wearers or for the different types of knots which may be tied in a four-in-hand necktie.

There is a need for an improved simple gauge to aid in reliably tying neckties into proper alignment.

BRIEF SUMMARY OF THE INVENTION

This invention is an improved gauge to aid in tying neckties into proper alignment. The improved gauge of this invention overcomes some of the problems and deficiencies of prior art devices, including those mentioned above.

The necktie-tying gauge of this invention includes a long narrow flexible piece, preferably a flat strip, of predetermined fixed length and suitable to be temporarily draped around the user's neck. The flexible piece has two ends, one of which is referred to as a proximal end and the other as a distal end because of how they are used as a gauge in the tie-tying operation.

End fastening means are fixed on the piece near its proximal end, and middle fastening means are fixed on the piece at a predetermined intermediate position which is spaced from the end fastening means by a distance greater than the circumference of a man's neck. The end and middle fastening means may be joined together when the flexible piece is draped around the back of the user's neck with the proximal and distal ends hanging generally along his shirtbutton line.

With the fastening means joined and the piece hanging along the shirtbutton line as described, the distal end of the flexible piece marks the proper position for the wide ends of untied ties and the attachment point of the end and middle fastening means marks the proper position for initial crossover in the tie-tying or serves as a reference for proper crossover.

The flexible narrow piece is simply hung around the user's neck just prior to his putting a tie around his neck for tying, and it can remain around the user's neck while the tie is being tied. Thereafter, it is removed and simply hung on a hook or tierack until the next time the user wishes to put on one of his neckties. In this manner, all of the user's ties can be properly and reliably tied without difficulty. Furthermore, the improved gauge is so simple and small that it may readily be carried with the user's ties in his suitcase when he is away from home.

The middle fastening means, described generally above, preferably includes at least two middle fasteners which are spaced apart by a short distance, each being affixed to the flexible piece. The user will join one of the two or more middle fasteners to the end fastening means, selecting a middle fastener based on the type of knot he intends to tie.

It is well known what some types of knots use more of the necktie length in forming the knot. For example, a single slip knot takes less length than does the double slip knot, commonly referred to as the Windsor knot. The user will select the middle fastener nearer proximal end if he wishes to tie a Windsor knot and one nearer the distal end if he wishes to tie a single knot.

The end fastening means also preferably has at least two end fasteners spaced apart by a short distance and each affixed to the flexible piece. The use of two or more end fasteners adapts the gauge for use by men of differing neck circumferences. Thus, the end fastener closer to the proximal end will be chosen for a user having a large neck circumference, and an end fastener spaced a short distance therefrom will be used by a man having a smaller neck circumference.

Of course, a particular user will soon determine which of the two or more end fasteners is most appropriate for his neck size.

The end fastening means and middle fastening means are preferably female/male snap members. For example, male snap members may be used as the end fasteners while corresponding female snap members are used as the middle fasteners. A variety of other fastening means may be used, including small patches of interlocking fabrics of the type known as "Velcro."

OBJECTS OF THE INVENTION

It is an object of this invention to provide an improved necktie-tying gauge overcoming some of the problems and shortcomings of gauges of the prior art.

Another object of this invention is to provide an improved gauge to aid in tying neckties which may be used for an entire collection of neckties rather than just one.

Another object of this invention is to provide a necktie-tying gauge which provides guidance while the tying operating is being carried out.

Another object of this invention is to provide a simple tie-tying gauge which may readily be carried in a man's suitcase while traveling.

These and other objects will be apparent from the following additional descriptions and from the drawings, in which:

DETAILED DESCRIPTION OF PREFERRED EMBODIMENTS

Figure 1:
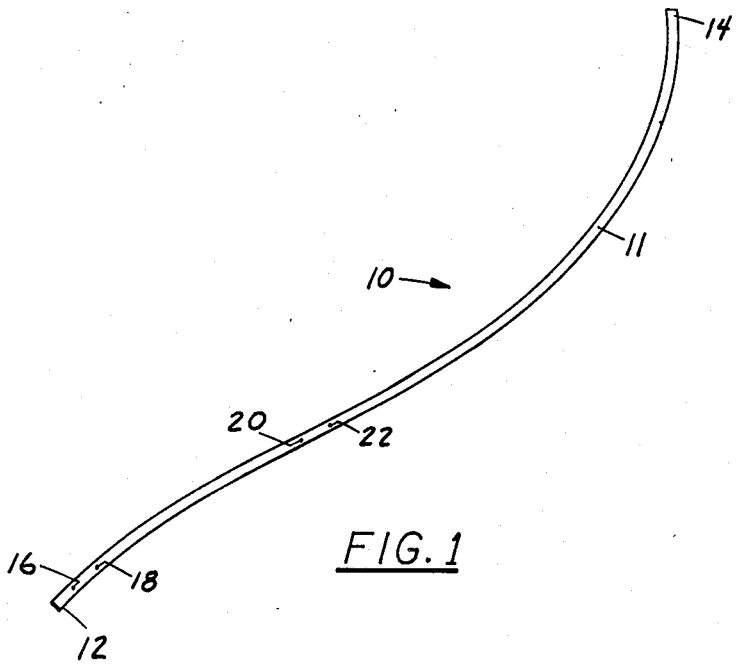
FIG. 1 is a perspective view of a preferred necktie-tying gauge in accordance with this invention.

The drawing shows a necktie-tying gauge 10 in accordance with this invention. Gauge 10 is a long narrow flexible flat strip 11 made of supple leather, plastic, fabric, or some other flexible material of substantially fixed length. Strip 11 has a constant narrow width along its entire length.

Strip 11 has a proximal end 12 and a distal end 14. First and second end fastening devices 16 and 18, respectively, are affixed to strip 11 near proximal end 12. Second end fastening device 18 is spaced from first end fastening device 16 a short distance along the length of strip 11. Such spacing may be on the order of an inch or two, based on the differences in typical neck circumferences. More than two end fastening devices could be used, with the end fastening devices spaced more closely.

First and second middle fastening devices 20 and 22, respectively, are affixed to strip 11 in a generally intermediate position spaced from end fastening devices 16 and 18 by a distance which is more than the circumference of a man's neck.

First and second middle fastening devices 20 and 22 are spaced from one another by an amount approximating the additional length of tie material which is need to tie a double slip knot over and above the length required to tie a single slip knot. The spacing between fastening devices 20 and 22 bears no relationship to the spacing between fastening devices 16 and 18, although in fact those lengths may be approximately equal.

The end fastening devices 16 and 18 are each made to be joined with either one of the middle fastening devices 20 and 22. End fastening devices 16 and 18 are male snap members and middle fastening devices 20 and 22 are female snap members.

Figure 2:
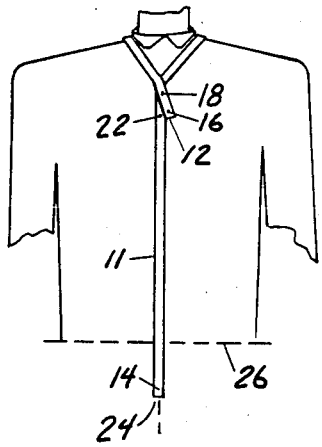
FIG. 2 is a front view of a person wearing the gauge of this invention in preparation for putting on and tying a necktie.

The use of the device is illustrated in FIG. 2. Just prior to placing a tie around one's neck and tying it, gauge 10 is draped loosely around the neck, just below the shirt collar or somewhere on or near the shirt collar, depending on the user's preference, with proximal and distal ends 12 and 14 hanging along the user's shirtbuttom line 24. Then one of the ends is pulled until gauge 10 is in position such that the appropriate end fastening device is attached to the appropriate middle fastening devices.

As shown in FIG. 2, second end fastening device 18 is attached to first middle fastening device 20. The user has selected second end fastening device 18 because his neck size is not large. Each time he uses gauge 10 he would use second end fastening device 18, attaching it to one of the middle fastening devices 20 or 22, depending on what sort of knot he intends to tie. He has chosen first middle fastening device 20 because he intends to tie a Windsor knot. Having chosen first middle fastening device 20, distal end 14 of strip 11 hangs farther down below belt line 26 than it would if he had chosen second middle fastening device 22.

Now the user places a necktie (not shown) around his neck and aligns the wide end of the necktie even with distal end 14 of gauge 10. He then makes the initial crossover of the wide portion of the necktie over the narrow portion of the necktie at the juncture of second end fastening device 18 and first middle fastening device 20, which have been joined together, and proceeds to tie a Windsor knot.

Having followed these guides, the tie will be tied on his first try with the wide and narrow tie ends in proper alignment with one another. It will be unnecessary for the user to untie and retie repeatedly.

As soon as the tying operation is completed or, if the user wishes, before the tying is completed, gauge 10 is removed and put in a place of storage to be used again later.

When a particular person starts using the gauge of this invention to aid in tying his neckties, he may wish to trim strip 11 to a shorter length to suit his purposes. Once he has used the gauge, he will find it helpful every occasion he uses it, and will no longer experience the problems mentioned above.

While the principles of this invention have been described in connection with specific embodiments, it should be understood clearly that these descriptions are made only by way of example and are not intended to limit the scope of this invention.

What is claimed is:

1. An improved gauge to aid in tying neckties into proper alignment comprising:

a long narrow flexible non-garment piece of predetermined fixed length and suitable for temporary draping around one's neck, said piece having a proximal end and a distal end;

at least two snap-type end fasteners permanently affixed to the piece immediately adjacent to the proximal end;

at least two snap-type middle fasteners for selective cooperative engagement with one of said end fasteners, said middle fasteners being permanently affixed to the piece at a predetermined intermediate position spaced from the end fasteners by a distance more than the circumference of one's neck, the end and middle fasteners being joinable without additional fastener means; and the middle fasteners spaced apart by a short distance such that each of them when joined to one of the end fasteners provides proper tie end and crossover positions for a particular selection of knot, and the end fasteners spaced apart by a short distance whereby the gauge is adaptable for use by men of differing neck circumferences, whereby with the fastening means joined and the piece hanging along one's shirtbutton line the distal end and the attachment point serve as references for proper necktie positioning and initial crossover in tying.

2. The improved gauge of claim 1 wherein the piece is a flat narrow strip.

* * * * *

UNITED STATES PATENT OFFICE

CERTIFICATE OF CORRECTION

Patent No. 4,682,419 Dated July 28, 1987

Inventor(s) LEO E. LYNCH

It is certified that error appears in the above-identified patent and that said Letters Patent are hereby corrected as shown below:

On the title page
Correct the address of the Inventor to read:

Route 3, Box 467
-- Rogers, Arkansas 72756 --

Signed and Sealed this

Second Day of February, 1988

*Attest:*

DONALD J. QUIGG

*Attesting Officer*

*Commissioner of Patents and Trademarks*